United States Patent [19]

Ausnit

[11] 4,199,845

[45] Apr. 29, 1980

[54] SLIDER FOR HEAVY DUTY FLEXIBLE FASTENER TRACKS

[75] Inventor: Steven Ausnit, New York, N.Y.

[73] Assignee: Minigrip, Inc., Orangeburg, N.Y.

[21] Appl. No.: 876,020

[22] Filed: Feb. 8, 1978

[51] Int. Cl.[2] ..... A44B 19/04

[52] U.S. Cl. ..... 24/201 C; 24/205.12

[58] Field of Search ..... 24/201 C, 205.12

[56] References Cited

U.S. PATENT DOCUMENTS

| | | | |
|---|---|---|---|
| 2,160,819 | 6/1939 | Behrens | 24/205.12 |
| 2,739,089 | 3/1956 | Hageltorn | 24/201 C |
| 3,085,367 | 4/1963 | Ridder | 24/201 C |
| 3,173,184 | 3/1965 | Ausnit | 24/201 C |
| 3,220,076 | 11/1965 | Ausnit | 24/201 C |
| 3,334,387 | 8/1967 | Gauthier | 24/205.15 R |
| 3,423,802 | 1/1969 | Hytonen | 24/201 C |
| 3,627,600 | 12/1971 | Reiter | 24/201 C |
| 3,790,993 | 2/1974 | Gilles | 24/201 C |

FOREIGN PATENT DOCUMENTS

| | | | |
|---|---|---|---|
| 257509 | 10/1967 | Austria | 24/201 C |

*Primary Examiner*—Ramon S. Britts

*Attorney, Agent, or Firm*—Hill, Van Santen, Steadman, Chiara & Simpson

[57] ABSTRACT

A flexible reopenable slide closure structure having first and second flexible plastic continuous fastener strips each having at least three continuous coactingly shaped interlocking releasable rib and groove elements extending along the strip with a closure slider positioned on the strips and guided to move therealong in a closing direction with the slider having opposing faces for pressing the strips together, one of the faces having a raised ridge extending laterally across the strip and extending at an angle to the direction of the strips so that the strips are pressed together in such a way that the ribs and grooves at one side are interlocked first with the ribs and grooves at the center second and the ribs and grooves at the other side last so that the ribs and grooves do not laterally fight each other while moving to closing relationship.

8 Claims, 8 Drawing Figures

SLIDER FOR HEAVY DUTY FLEXIBLE FASTENER TRACKS

BACKGROUND OF THE INVENTION

The invention relates to improvements in flexible plastic zippers of the type having continuous interlocking ribs and grooves thereon, and more particularly to an improved slider structure and a method of closing heavy duty fastener strips which have three or more rib and groove elements thereon.

In flexible fastener strips of the type that are formed of plastic manufactured by continuously being extruded from a die, the rib and groove elements are matingly shaped so as to interlock when pressed together in a direction normal to the lock. In applying a closing pressure, the strips are pressed together either between a thumb and forefinger or by a slider which is moved along the strips. The ribs and grooves are forced to interlock in position as the normal pressure is applied, with the rib forcing the groove open as it is pushed into it and deflecting its sides sideways until the groove formed between the ribs opens far enough to admit the opposing rib and then interlocks in the grooves.

On heavy duty strips of the type which have three or more tracks, closure cannot be accomplished without considerable effort because the lateral deflection cannot occur. In other words, as ribs are pressed into the grooves on a heavy duty strip having three ribs and three grooves, the ribs forming the sides of the groove cannot push apart, but instead will fight each other. As the ribs on each side of one of the grooves spread apart, the one rib in the middle will move over further onto the other groove so that it reduces the size of the groove. In order to successfully close the fastener, the ribs must spread so that each of the grooves is made wider to admit the ribs of the opposing strip. While this is possible on a two track fastener, it is not possible on a three or more track fastener. Thus, it has been found to be considerably impractical to attempt to close a heavy duty fastener with three or more tracks, due to the fact that the strips fight each other so that when the sides of the groove tend to spread for one groove, one of the sides closes the other groove, instead of opening it. This problem is further aggravated when the fastener being closed is constrained by the sides of the slider that is closing it. Added to the problem described above is the friction of the extra substantial surface of the plastic that is being forced into the interlocking mode. This can be overcome in part by putting a coating of silicone on the zipper track. However, while this permits the slider to move more easily, it does not accommodate the problem of affording more space for the heads and teeth to bypass each other and to snap into position.

In accordance with the principles of the present invention, a method is employed wherein the different ribs and grooves of each of the tracks are closed progressively, one after another, so that each one has enough room to interlock before the next one to it is required to respond in the same way. In accordance with the principles of the invention, this is accomplished by a structure that provides for an angled indentation or for welding an angle bar either on the top or bottom of the inside slider surface between the end of the slider and the separating bridge. The angled bar successively deforms and interlocks the rib and grooves one after the other from one side to the other side of each of the strips.

Accordingly, it is an object of the present invention to provide an improved method and apparatus for the closing of a heavy duty plastic strip having three tracks or more thereon.

A further object of the present invention is to provide an improved closure method and structure for closing heavy duty plastic zippers on the order of those which measure in thickness from between 175 mils to 300 mils or more when interlocked.

A further object of the invention is to provide an improved slider construction which is capable of accomplishing the closing of heavy duty strips having interlocking rib and groove elements thereon wherein the structure of the slider is simplified so that it can be easily manufactured and can be easily adapted or installed, and is capable of long wear and does not require extremely close manufacturing tolerances.

Other objects, advantages and features, as well as equivalent structures and methods which are intended to be covered herein, will become more apparent with the teaching of the principles of the present invention in connection with the disclosure of the preferred embodiment in the specification, claims and drawings, in which:

DRAWINGS

DESCRIPTION

Figure 1:
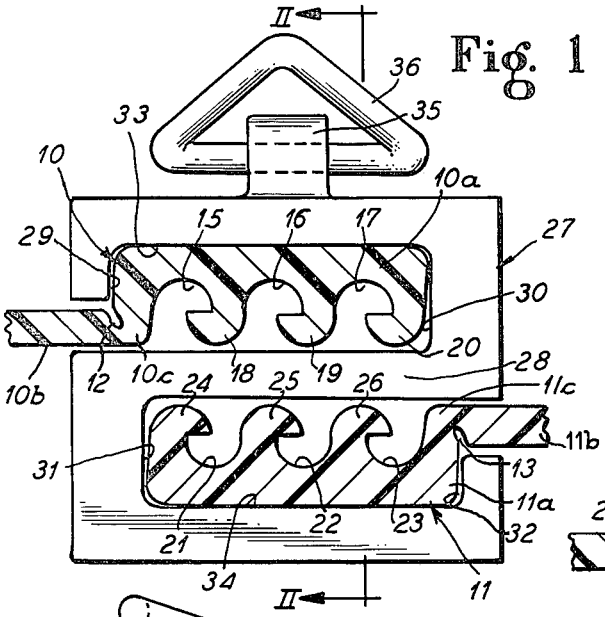
FIG. 1 is an end elevational view of a slider straddling flexible plastic fastener strips constructed and operating in accordance with the present invention, with a section taken through the slider parts.

FIG. 1 illustrates a pair of flexible plastic fastener strips which usually will be of identical construction. Each of the strips has a series of at least three complementary coactingly shaped interlocking releaseable rib and groove elements comprising teeth with grooves between the teeth facing the other strip. The grooves and teeth are longitudinally continuous on the strips, and the strips are interlocked by pressing them toward each other. In fastener strips which are provided with only one or two interlocking teeth and grooves on each of the strips, as the strips are pressed together, the teeth at each side of the groove will spread apart to provide access to the groove for the opposing teeth. Where there are three or more teeth and grooves involved, this cannot occur as will become more clear.

The upper strip 10 has a thicker marginal portion **10*a* which contains the ribs and grooves, and a web portion 10*b* which attaches to a sheet or film such as by heat welding, or may be itself a sheet or film where the strip is integral with such sheet. The lower strip 11 has the thicker marginal portion 11*a* and web portion 11*b* along the side. Each of the strips may have a slight recession or notch 12 and 13** between the marginal portion and the web to accommodate easier flexing between the marginal portion and web.

The strip 10 has shaped teeth 18, 19 and 20 with grooves 15, 16 and 17. The teeth are positioned at one side of the grooves and the inner groove 15, that is, the groove next to the web 10*b* is formed between the tooth 18 and a shoulder 10*c*.

The strip 11 has teeth 24, 25 and 26, and grooves 21, 22, and 23. The inner groove 23 is formed between the tooth 26 and a shoulder 11*c*.

In a strip which has only two grooves, when one strip interlocks with another strip, the teeth or shoulders on the outside tend to spread apart, and the tooth between the grooves tends to remain stationary. By the outwardly positioned teeth spreading apart, the grooves become wider to admit the teeth. However, when there are three grooves, both center teeth remain stationary and the middle groove does not get any larger and does not admit its opposing tooth. More specifically, when the two strips shown in FIG. 1 are pressed together in a usual fashion by merely applying a closing pressure normal to the surfaces of the strips, the outer tooth 20 and the shoulder 10*c* tend to spread apart and the outer grooves 15 and 17 will widen, but the inside teeth 18 and 19 have nowhere to shift, and the center groove 16 does not open up to admit its tooth. If either of the teeth 18 or 19 tend to spread apart to widen the center groove 17, they are then moving in a direction to close their respective grooves 15 and 17 outwardly of them. With this result, the teeth tend to fight each other in a three groove strip and the strips cannot readily interlock together by normal pressing as it possible with two groove strips. This results in the strips tending to flatten out without the grooves opening, so that the strips resist being pressed together. This difficulty is aggravated when heavier material is used such as is normally necessary with a stronger fastener of the type that requires three or more grooves. The heavier material does not flex as easily, and three groove fasteners have been found to function unsatisfactorily because of this difficulty.

Figure 4:
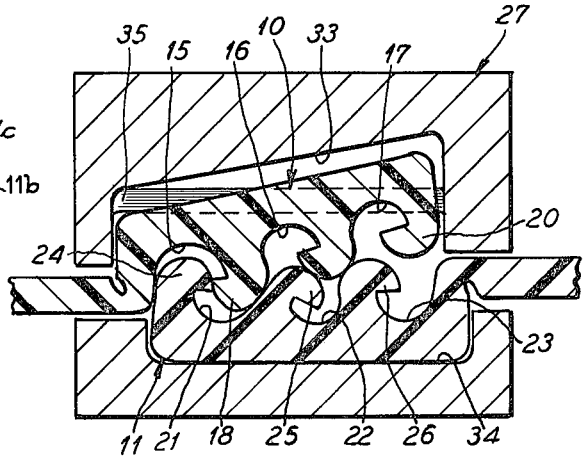
FIG. 4 is a vertical sectional view taken substantially along line IV—IV of FIG. 2.
Figure 3:
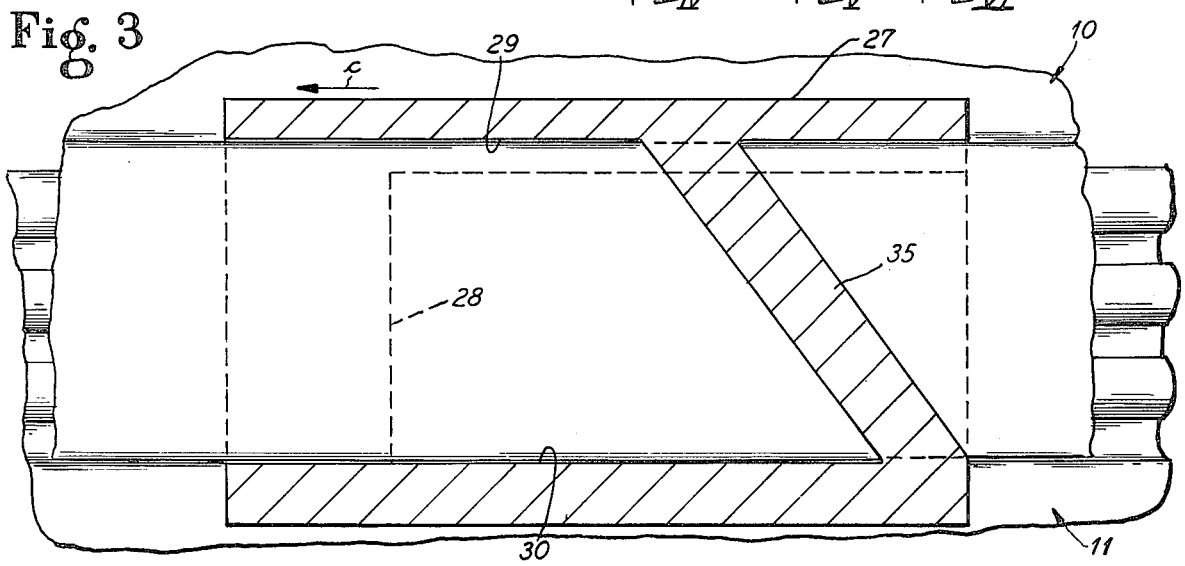
FIG. 3 is a sectional top view taken substantially along line III—III of FIG. 2.
Figure 5:
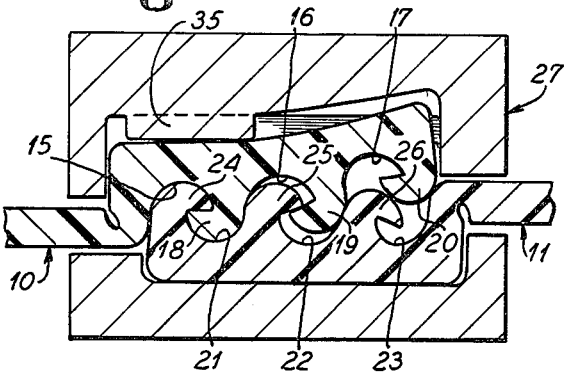
FIG. 5 is a vertical sectional view taken substantially along line V—V of FIG. 2.

In accordance with the present invention, a unique slider 27 is provided which closes the three groove fastener in a progressive manner so that the teeth are not shifted against each other, and the strips close and interlock with the same coaction as occurs in a one or two groove strip. The slider 27 is slidably mounted on the strips so that they close when the slider is moved in a closing direction, as indicated by the arrowed line C in FIGS. 3 and 4, and the strips will open and separate when the slider is slid in an opening direction.

The slider 27 is usually formed of metal, but may be made of molded plastic or other similar material and is generally S shaped when viewed from the oppsoing end.

The slider is arranged to have confronting or opposing first and second faces 33 and 34, respectively which press the strips toward each other for pressing the strips together to interlock the rib and groove elements. The face 33 is uniquely constructed so as to have a raised ridge 35 extending at an angle to the direction of the strips so that the strips are progressively interlocked with one tooth first pressed into its opposing groove and then the next succeeding tooth, and then the next, thereby permitting the teeth on the opposing strips to spread open their respective grooves one at a time.

At the sides of the slider are means for guiding the slider along the strips, the upper face 33 providing a channel for the upper strip 10 and having inner opposite sides shoulders 29 and 30 which hold the slider in alignment with the strip and permit it to slide therealong. For the lower strip 11, the slider face 34 has a channel providing inwardly facing opposite side shoulders 31 and 32 which slide along the sides of the strip to also hold the slider in alignment.

Figure 2:
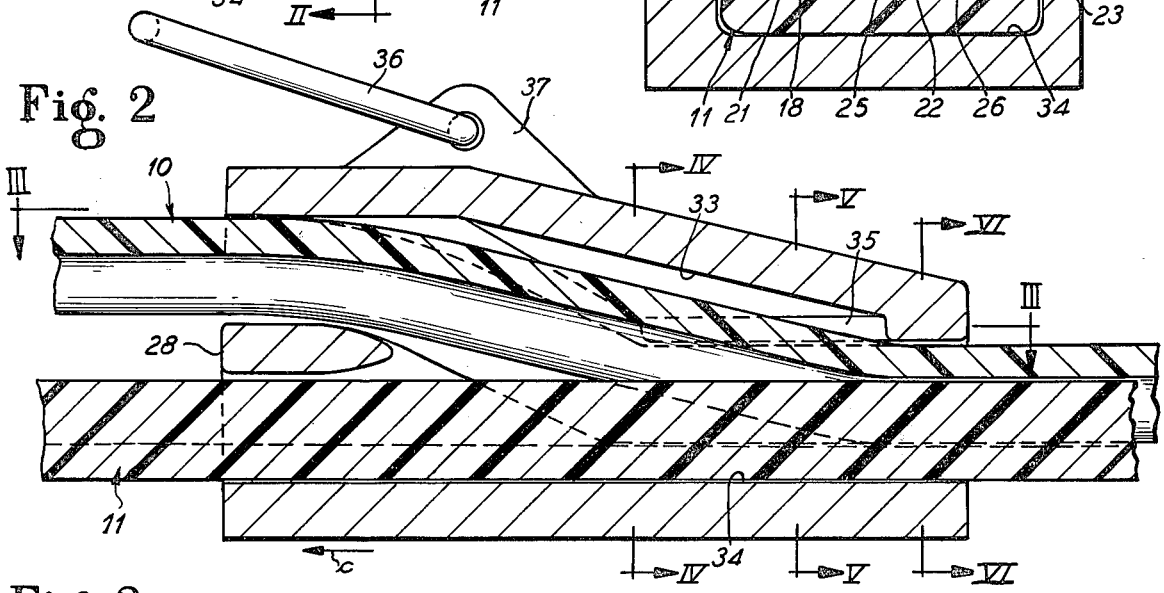
FIG. 2 is a sectional view taken substantially along line II—II of FIG. 1.
Figure 7:
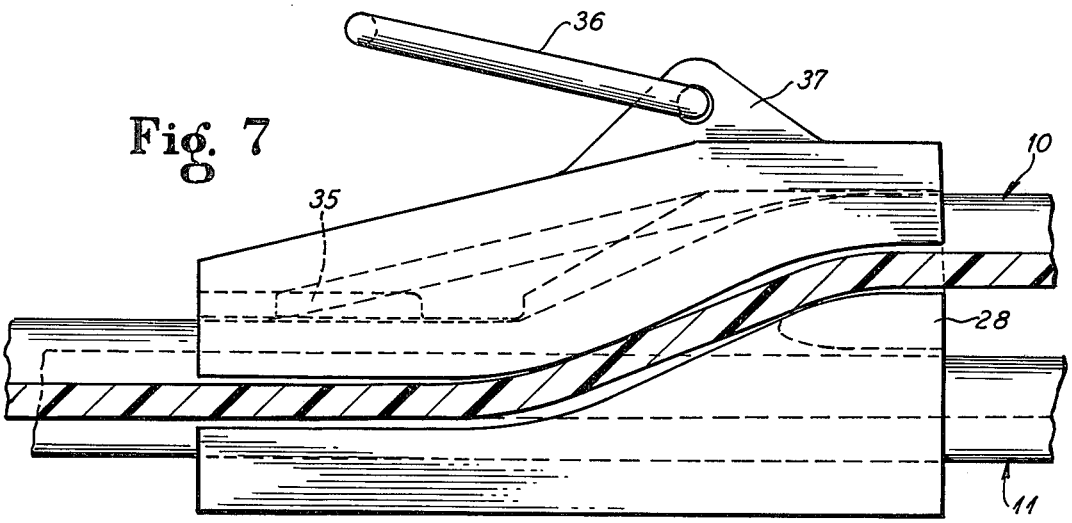
FIG. 7 is an elevational view of the slider taken from a direction opposite that of the view of FIG. 2.
Figure 8:
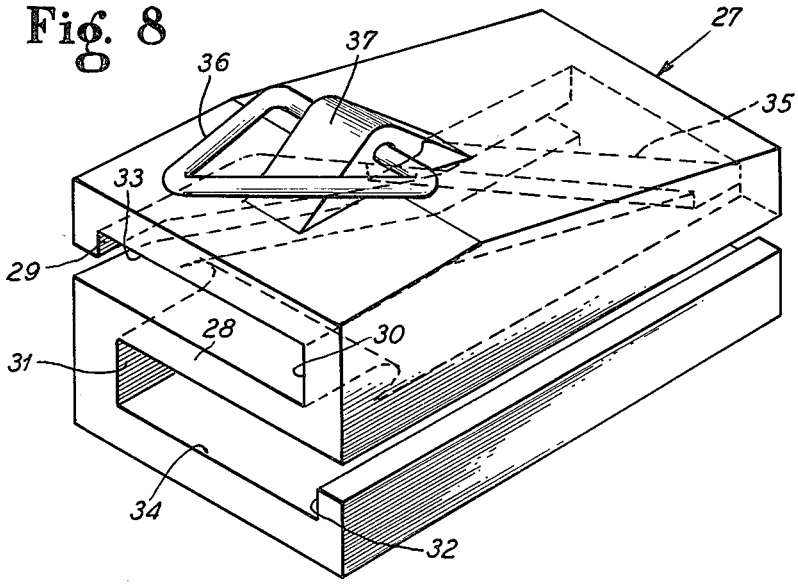
FIG. 8 is a perspective view of the slider.

At the opening end of the slider 27 is a separator finger 28, FIGS. 2, 7 and 8, which pulls the strips apart to separate them when the slider is moved in an opening direction.

For manually drawing the slider along, it has a projection 37 and an opening therethrough for a tab 36 for gripping and pulling the slider.

Figure 6:
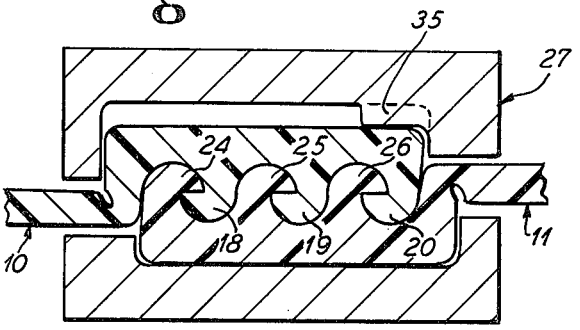
FIG. 6 is a vertical sectional view taken substantially along line VI—VI of FIG. 2.

The unique closing ridge 35 which projects from the face 33 toward the face 34, extends at an angle from one side of the strip to the other side of the strips as shown in FIGS. 2 through 6. As the slider moves in a closing direction, the ridge 35 will press the top strip against the lower strip which is firmly supported on the surface 34 of the slider. The strips begin to interlock, with the lower tooth 24 first entering the groove 15 of the upper strip, FIG. 4. Immediately following the upper tooth 18 enters the groove 21 of the lower strip. Next, the lower tooth 25 will enter the upper groove 16 and then the upper tooth 19 will enter the lower groove 22, FIG. 5. Next, the lower tooth 26 will enter the upper groove 17 and finally, the upper tooth 20 will enter the lower groove 23, until the fastener is closed, as shown in FIG. 6. During the progressive interlocking action effecting pressing of the strips together progressively from one side of the strips and faces to the other side of the strips and faces, the teeth beside each of the grooves can spread apart to open the groove, and essentially the teeth are progressively moving to the right, FIGS. 4 and 5, as the strips are pressed together, and then snapping into place. The ridge 35 essentially performs sort of a twisting action on the fastener permitting progressive closing. While the ridge 35 is preferably continuous, it may be considered as having a series of portions with a first leading portion first pressing the ribs and grooves at one side of the strip together and then successive second portions, having regard to the closing direction of movement of the slider, and adapted for pressing laterally successive portions of the strip together. A continuous angular shape of the ridge is preferred because of the smooth progressive action, but other variations in shapes and projections may be employed in accordance with the practice of the method.

When the slider is moved in the opposite direction and the strips are pulled apart, the teeth can elongate or stretch out and thereby become narrower so that a problem is not presented by an opening process. However, when the strips are normally pressed together by methods heretofore used where a pressure is applied uniformly across the strip, the teeth tend to flatten out and try to find a position where the groove will widen and admit the opposing teeth and this flattening further complicates and aggravates the problem so that the grooves do not open, and as a result, the strips will not interlock. By the present structure and arrangement, the strips will interlock as smoothly as if strips with a single or two grooves were used, and the arrangement will readily accommodate itself to very stiff thick strips, and also to strips having more than three grooves and teeth. This results from the arrangement whereby at least one of the rib and groove elements is pressed into interlocking relationship at a different time than the other rib and groove elements so that the rib and groove elements do not laterally fight each other in moving to closing relationship.

I claim as my invention:

1. A flexible reopenable slide closure structure comprising in combination:

first and second flexible plastic continuous fastener strips each having at least three complementary continuous coactingly shaped interlocking releaseable rib and groove elements extending longitudinally on the strips;

and a closure slider positioned on said strips having means for guiding the slider along the strips and having first and second faces in opposing relationship for pressing the strips together to interlock said rib and groove elements when the slider is moved in a closing direction along the strips, said first face having a ridge which projects toward said second face for pressing the strips together progressively from one side of the strips and faces to the other side of the strips and faces, said ridge extending from said one side to said other side laterally across the strips and having a first leading portion and a second portion with the second portion located in successive relationship to the first portion having regard to said closing direction so that at least one of said rib and groove elements is pressed into interlocking relationship at a different time than the other rib and groove elements, so that said rib and groove elements do not laterally fight each other in moving to closing relationship.

2. A flexible reopenable slide closure structure constructed in accordance with claim 1:

wherein said first and second portions extend at an oblique angle to the strips.

3. A flexible reopenable slide closure structure constructed in accordance with claim 1:

wherein said first and second portions extend at an oblique angle and are continuous with each other so as to form a single continuous ridge angle with respect to the direction of the strips.

4. A flexible reopenable slide closure structure constructed in accordance with claim 1:

wherein said slider has channels for straddling the strips and holding the slider parallel thereto as it moves along the strips.

5. A flexible reopenable slide closure structure constructed in accordance with claim 1:

wherein each of said strips has three ribs and three grooves with the ribs of one strip interlocking into the grooves of the other.

6. A flexible reopenable slide closure structure constructed in accordance with claim 1:

wherein said strips have marginal web portions for attachment to adjoining plastic sheets and the strips are thicker than the web portions so as to provide laterally facing shoulders for guiding the slider therealong.

7. A closure slider for pressing together into closing relationship first and second flexible plastic continuous fastener strips each having at least three complementary coactingly shaped interlocking releasable rib and groove elements extending longitudinally on the strips, comprising:

a slider member positioned on the strips and having means for guiding the slider along the strips and having first and second faces in opposing relationship for pressing the strips together to interlock said rib and groove elements when the slider is moved in a closing direction along the strips and one of said faces having a ridge pressing the strips together progressively from one side of the strips and faces to the other side of the strips and faces, said ridge extending from said one side to said other side laterally across the strips and having a first leading portion and a second portion with said portions arranged in successive relationship to each other so that at least one of said rib and groove elements is pressed into interlocking relationship at a different time than the other rib and groove elements so that said three rib and groove elements do not laterally fight each other in moving into closing relationship.

8. A closure slider constructed in accordance with claim 7:

wherein said ridge is formed in a continuous structure and extends obliquely angularly across the strips so that the rib and groove at one edge are pressed together first, next the central rib and groove are pressed together, and the rib and groove at the other side of the strip are pressed together last as the slider is moved in a closing direction.

* * * * *